United States Patent [19]

Blomqvist

[11] Patent Number: 4,502,681

[45] Date of Patent: Mar. 5, 1985

[54] APPARATUS FOR CARRYING OUT QUADRICEPS TRAINING

[76] Inventor: Olle Blomqvist, Artillerigatan 38, S-114 45 Stockholm, Sweden

[21] Appl. No.: 290,711

[22] Filed: Aug. 6, 1981

[30] Foreign Application Priority Data

Aug. 8, 1980 [SE] Sweden ..... 8005618

[51] Int. Cl.[3] ..... A63B 21/02

[52] U.S. Cl. ..... 272/142; 272/DIG. 5; 272/900; 272/117

[58] Field of Search ..... 272/117, 122, 123, 134, 272/138, 144

[56] References Cited

U.S. PATENT DOCUMENTS 2,855,199 10/1958 Noland et al. ..... 272/134 X
3,000,632 9/1961 Fuchs ..... 272/117
3,103,357 9/1963 Berne ..... 272/134 X
3,120,954 2/1964 Apostol ..... 272/134 X
3,285,070 11/1966 McDonough ..... 272/134 X

*Primary Examiner*—Steven A. Bratlie
*Assistant Examiner*—William R. Browne
*Attorney, Agent, or Firm*—Cushman, Darby & Cushman

[57] ABSTRACT

A device for counteracting knee joint pressure in quadriceps training including a rotatable resistance arm having a foot attachment device connected to the resistance arm where the foot attachment device includes an elastic member and the axis of rotation of the person's knee and of the resistance arm are displaced from one another in such a way that the leg of the user during the stretching out movement is subjected to a tractional force from the elastic member due to the fact that the point of attachment of the attachment device on the foot travels along one arc during the rotational movement that is different from the point of attachment of the attachment device on the resistance arm.

10 Claims, 14 Drawing Figures

APPARATUS FOR CARRYING OUT QUADRICEPS TRAINING

BACKGROUND OF THE INVENTION

This invention relates to apparatus for carrying out quadriceps training which comprises the components set forth in the preamble of claim 1.

The tractional force of the quadriceps muscle has a stabilizing component which is constituted by the force by which the bones of the thigh and the under-leg are pressed against each other in the knee joint. In some pathological cases in which quadriceps training is desirable the joint pressure corresponding to said force causes pain to the patient in his knee joint during such training.

The apparatus according to the invention is intended to be utilized for strength training of the quadriceps muscle in orthopedic cases, joint trouble and different paralysis conditions where progressivly increased resistance training, i.e. a gradually increased load torque which counteracts the straightening out of the leg of the patient in the knee joint is desirable.

When the leg at quadriceps training is loaded by a torque which counteracts pivoting (extension) of the leg in the knee joint, the stabilizing compressive force and the joint pressure will increase. In many cases this increased joint pressure causes the patient such a pain that quadriceps training in a conventional apparatus of the kind illustrated in FIG. 1 can not be carried out. The known quadriceps training apparatus shown in FIG. 1 comprises a stool, a chair or the like which may be converted to a bench and which is generally designated 1. At the fore edge 2 of the stool there are mounted two training apparatuses which are each generally designated 3. Each apparatus comprises a weight arm 4 along which a weight 5 may be displaced. The magnitude of the weight 5 may be adjustable. By means of a locking screw 6 the weight 5 may be fixed in the desired setting position. The weight arm 4 is rotatable on a shaft 7 on which also a torque or resistance arm 8 is rotatable or pivotable. The two arms may be set in an arbitrary angular position with respect to each other and then be rigedly interconnected by means of an apertured disc 9. The disc has a circle of bores and is rigidly united with the shaft 7 and the resistance arm 8. A spring biased bolt 14 is attached to the weight arm 4 and can be brought into engagement with anyone of the apertures of the circle of bores of the apertured disc 9.

When the bolt 14 has been brought into engagement with one of the apertures of the disc 9, the two arms 4, 8 may be rotated as one unit on the shaft 7 while defining a fixed angle with each other.

A cushion or pad 11 provided with fastening or tightening means is slidable along the resistance arm 8 by means of a sleeve 10 and may be fixed to the arm 8 at the desired distance from the axis of rotation 7 by means of a locking knob 12. By the fastening means which is tightened around the under-leg of the person, near the ankle, the resistance arm is united with the leg of the person.

At the training the knee joint(s) of the person is/are, according to the adjustment and operating manual for the quadriceps training apparatus, to be positioned coaxially with the shafts 7. During the training the patient may, among other things, carry out dynamical training, i.e. extending and bending the leg in the knee joint (the left leg), suitably under progressively or gradually increased load, and statical training (the right leg), the leg being maintained extended, loaded by a suitable torque. Hereby an auxiliary support for the weight arm 4 may be utilized.

When the knee joint of the person according to the above is so positioned that it registers with the pivot axis 7 of the quadriceps training apparatus and the patient is training with the knee joint loaded by a torque which counteracts extension of the knee joint, the bones of the knee are pressed against each other with a considerable force, which often causes the patient pain in some pathological cases, as has been set out above.

SUMMARY OF THE INVENTION

The principal object of the invention is to provide an apparatus which reduces the pressure in the joint and on account hereof alleviates such pain at quadriceps training.

This object is attained thanks to the fact that the apparatus according to the invention is so constructed as set forth in the characterizing clause of claim 1. Generally it is most suitable to subject the under-leg of the person to a traction or stretching with counteracts the increase of the compressive force at the extension of the leg from a bent position to a substantially straightened out position. By positioning the person in such a way that the axis of rotation of the resistance arm becomes substantially parallel to and located on the same side of the pivot axis of one of the knee joints of the person as the whole of his tigh-bone which belongs to said one knee joint, said extension is brought about automatically when the under-leg is pivoted from a bent position into an extended position, substantially registering or in line with the upper-leg. In other cases it may be desirable to replace or supplement this tractional force by an externally applied, preferably constant tractional or compressive force which acts substantially in the longitudinal direction of the under-leg.

BRIEF DESCRIPTION OF THE DRAWINGS

Further features and advantages of the apparatus according to the invention will become apparent from the following description and the annexed drawings in which FIGS. 2–9 diagrammatically and as non-limiting examples illustrate the principle of the invention and two preferred embodiments thereof.

In all Figures the same reference numerals are utilized throughout to designate the same or similar details.

DESCRIPTION OF THE PREFERRED EMBODIMENTS

Figure 2:
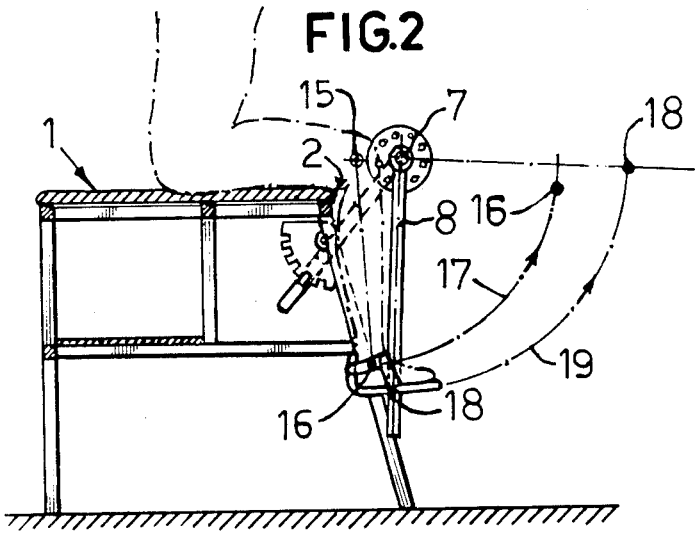
FIG. 2 is an explanatory sketch which illustrates the operation of the apparatus according to the invention.

The principle of the invention is diagrammatically illustrated in FIG. 2, in which the knee joint is designated 15 and the weight arm 4 is omitted to reduce the complexity.

In the apparatus according to the invention the patient is strapped at the stool or the like in such a way that his knee joint(s) become(s) stationary in space.

Figure 1:
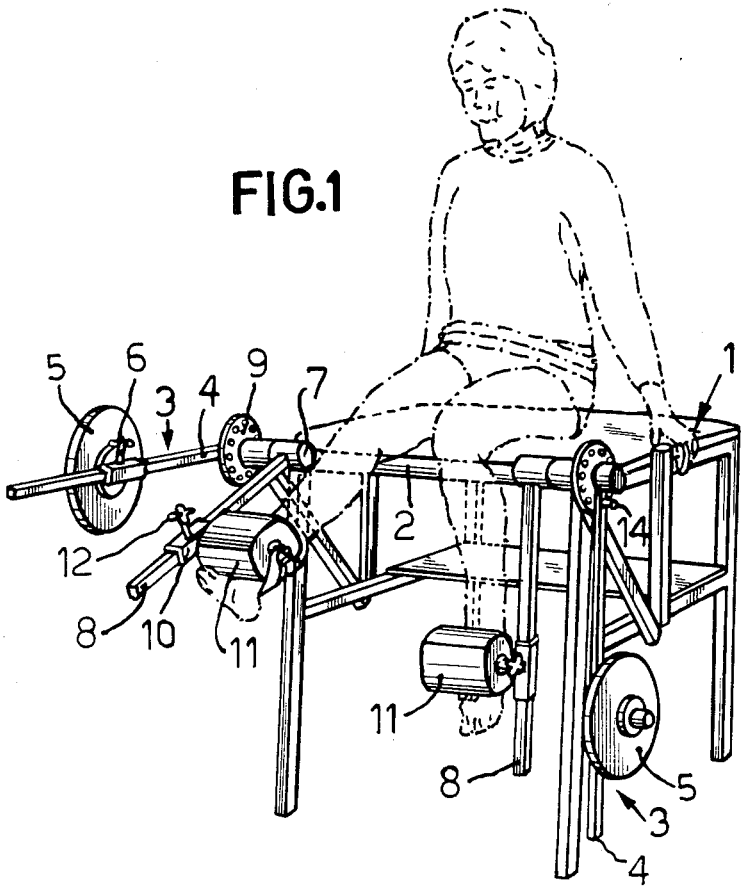
FIG. 1 is a perspective view of a known quadriceps training apparatus, as has become evident already from the above.

The cushion 11 described in conjuntion with FIG. 1 is now preferably replaced by special fixation shoe by means of which the foot of the patient is in principle fixed to the resistance arm 8. From FIG. 2 it is apparent that a point 16 corresponding to the fastening means of the cushion 11 on the leg of the patient, which is rotated with the knee joint 15 as axis of rotation at the extension of the leg, strives to move along the arc 17, while a corresponding point, especially the fastening of the fixation shoe, on the resistance arm which rotates on the axis 7 moves along the arc 19. The point 18 on the resistance arm is more distant from the edge 2 than the point 16 on the shoe in the extended position of the leg. Since the shoe is on the one hand attached to the foot and on the other hand connected to the resistance arm 8, it is recognized that a traction in the under-leg occurs at the pivotal movement shown in FIG. 2 on account of the difference in position between the points 16 and 18 which is brought about through said movement. Due to the fact that the bones have a constant length, the under-leg can not be extended. Consequently, it is necessary to introduce some sort of resiliency in the connection between the resistance arm 8 on one hand and the under-leg (the shoe) on the other hand. This resiliency may be brought about by a flexible mechanism on the resistance arm by which a tractional force in the longitudinal direction of the under-leg is created. The magnitude of this tractional force is determined partly by the characteristic of the spring force and partly by the distance between the pivot axes of the knee joint and the resistance arm, respectively. Different examples of means for creating such resiliency are illustrated in FIGS. 3–8.

Figure 3:
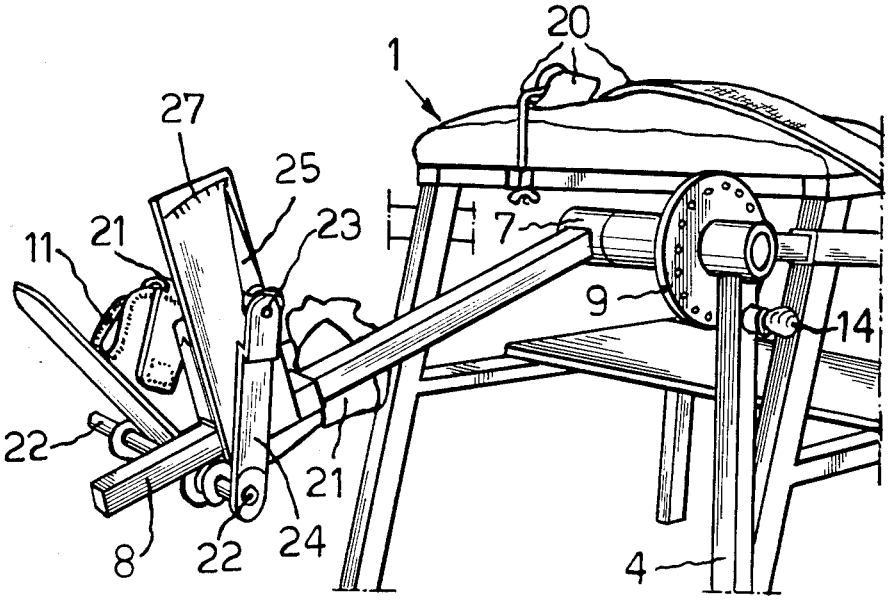
FIG. 3 is a perspective side view of a quadriceps training apparatus according to the invention.
Figure 4:
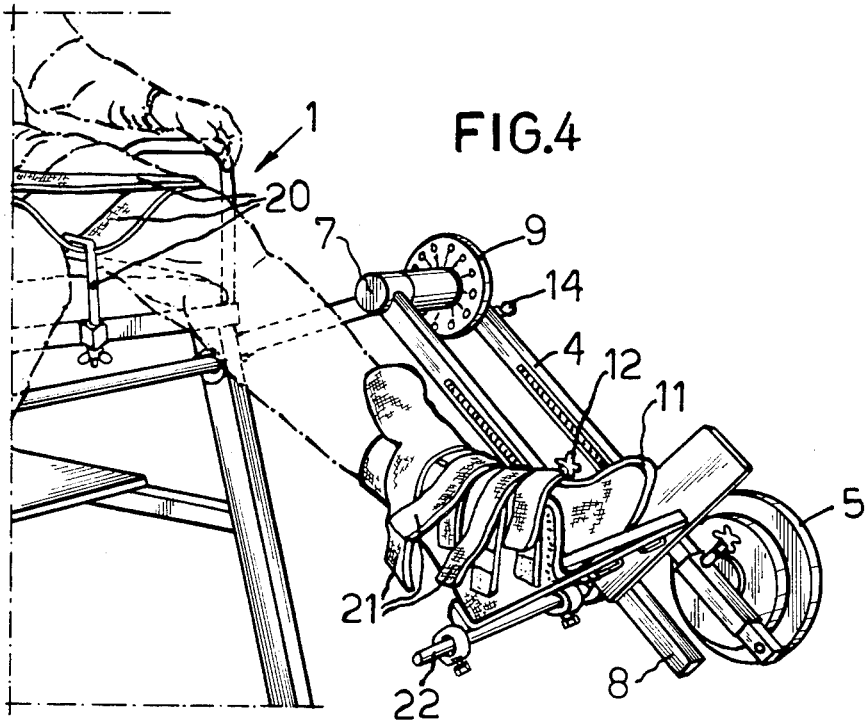
FIG. 4 is a side view as seen from the opposite side with respect to FIG. 3 and illustrates how the leg of the patient is fastened or strapped in the quadriceps training apparatus.
Figure 5:
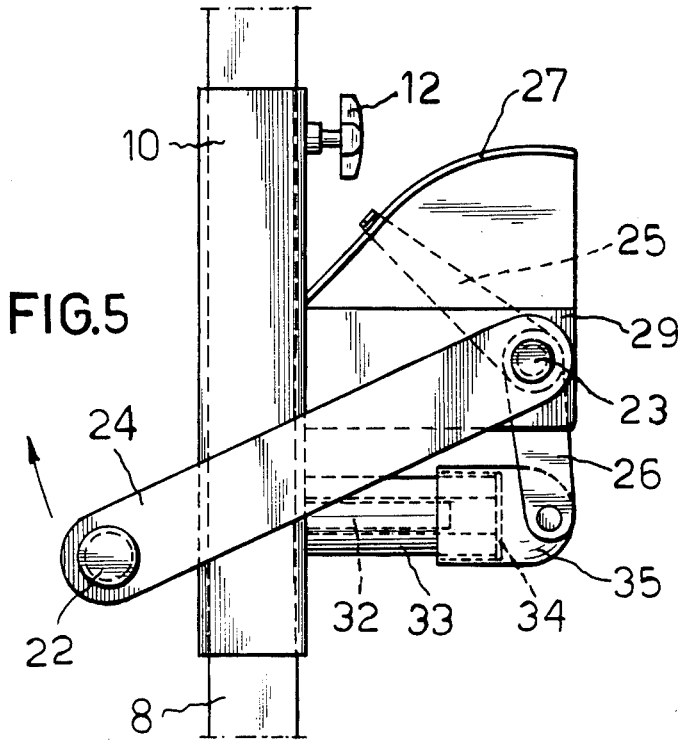
FIG. 5 is a partial side view of the principal parts of an apparatus according to the invention.
Figure 6:
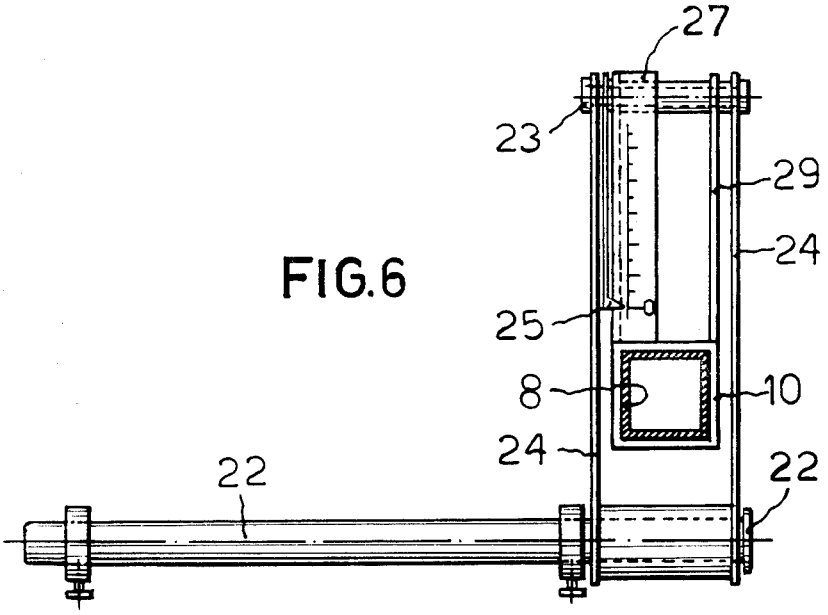
FIG. 6 is a partially sectional plan view corresponding to FIG. 5.

The features of such a resilient device are apparent from FIGS. 3–6 which diagrammatically illustrate a first embodiment of an apparatus according to the invention which is in practical use. In FIGS. 3 and 4 we find the stool of FIG. 1 in a modified design, the weight arm 4, the shaft 7, the resistance arm 8, the apertured disc 9 and the spring biased connection bolt 14. In this exemplificatory embodiment the stool or chair 1 has been supplemented with connection means 20 by which the patient may be strapped or tightened in such a way that at least one of his knee joints is fixed in a stationary position. Furthermore, the pad 11 has been replaced by a special fixation shoe 11 which corresponds to the cushion and is provided with tightening straps 21 by means of which the foot of the patient may be clamped substantially immovably with respect to the shoe as a whole. The shoe 11 is attached to a rod 22 which is connected to the free end of one arm 24 of a three-armed lever which is rotatable on a shaft 23. The arm 24 is double in the embodiment according to FIGS. 5–6. The lever has second arm 26 which is shown only in FIG. 5 and a third arm 25 which is comprised of a pointer which cooperates with and is movable along a scale 27. The three lever arms are rigidly interconnected with each other and with the shaft 23. (The lever arms form different angles with each other in FIGS. 3 and 5, but this is insignificant). The shaft 23 is journaled in two mutually parallel arms or plates, of which one is comprised of the scale plate 27 according to FIGS. 3–6 and the other is designated 29. The plates 27–29 are rigidly united with a sleeve 10 which corresponds to the sleeve 10 of FIG. 1 and is displaceable on the resistance arm 8, which according to FIGS. 3–6 is comprised of a square tube. As in the embodiment according to FIG. 1 the sleeve 10 may be locked to the resistance arm 8 in an arbitrary position by means of a screw 12 (FIG. 5). Rigidly secured to the sleeve 10 is also a bolt 32 which is embraced by a diagrammatically illustrated, tubular, resilient member 33, e.g. a coil spring or a rubber rod. The resilient element 33 cooperates with a support surface 34 which is provided in a cap or cage 35 which encloses the member 33 and is guided thereby. The cap 35 is hingedly connected to the second lever arm 26 of the lever.

When the patient during the quadriceps training extends his leg and turns his foot upwards, the rod 22 is pulled upwards and to the left according to the arrow in FIG. 5 in agreement with the discussion in conjunction with FIG. 2. This is experienced as a traction in the foot by the patient. Said traction or pivotal movement causes a compression of the resilient member 33 via the lever arm 26, the cap 35 and the surface 34. The magnitude of the compression which is dependent of said upward movement of the shaft 22 is indicated on the scale 27 by the pointer 25.

Figure 7:
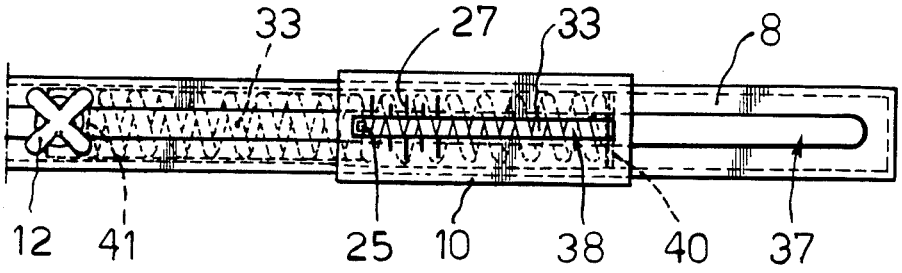
FIG. 7 is a plan view of that portion of the resistance arm of the quadriceps training apparatus which is of particular pertinence to the invention.
Figure 8:
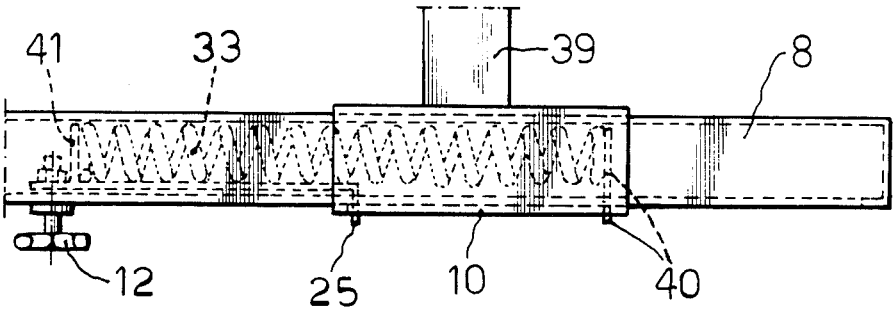
FIG. 8 is a side view corresponding to FIG. 7.

In the embodiment according to FIGS. 7 and 8 the resistance arm 8 has, as before, the shape of a square profile tube whose free end is the righthand end in FIGS. 7 and 8. On the profile tube which is provided with an elongated slot 37 is a sleeve 10 which has an elongated opening 38 and is displaceably arranged, as before. With the sleeve a diagrammatically illustrated fastening 39 (FIG. 8) corresponding to the shoe 11 and its strapping means is rigidly connected for fixation of the leg. The sleeve 10 is also provided with a first stop 40 for a spring 33 which corresponds to the elastic member 33 shown in FIG. 5 and is a compression spring in the illustrated embodiment. As is evident from FIGS. 7–8, the stop 40 extends through the slot 38. The spring 33 is arranged or inserted between the stop 40 and a second stop 41. The latter is rigedly connected on one hand with a locking device which comprises a knob corresponding to the locking knob 12 in FIG. 1, and on the other hand with a pointer 25 which corresponds to the pointer 25 in the embodiment first described and whose point projects through the opening 38 and cooperates with a scale on the sleeve 10.

From the discussion in conjunction with FIG. 2 it follows that a relative movement between the sleeve 10 and the resistance arm 8 is brought about by the pivotal movement of the leg discussed above, at which the sleeve travels to the left in relation to the arm 8 in FIGS. 7 and 8. Due to this movement the spring 33 becomes compressed which in its turn through the first stop 44 strives to push the sleeve 10 to the right. By the patient this is experienced as a traction in his under-leg on account of the fixation of the leg through the fastening 39. This traction eliminates or reduces the pressure between the bones in the knee joint.

Figure 9A:
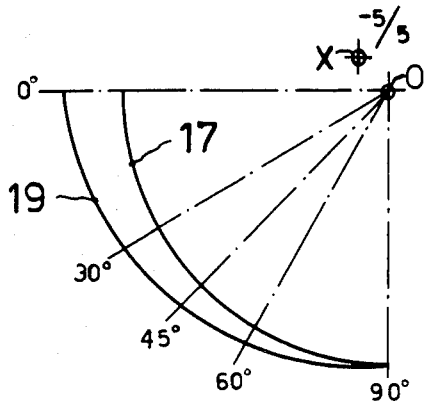
FIGS. 9A–9F are different traction diagrams each of which discloses a pair of movement tracks in the same way as FIG. 2.
Figure 9B:
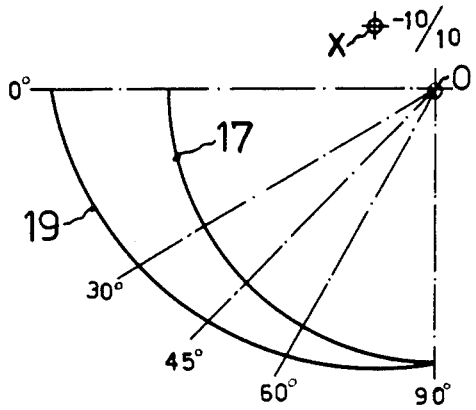
Figure 9C:
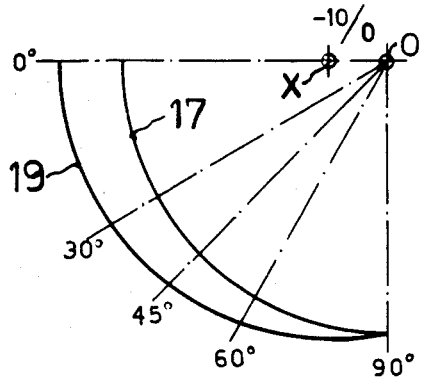
Figure 9D:
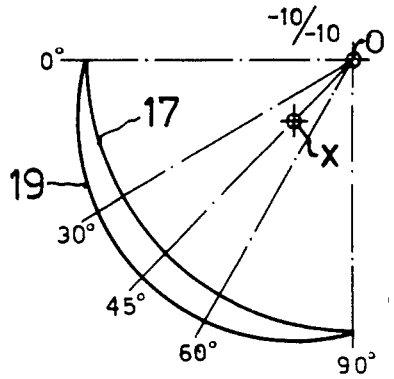
Figure 9E:
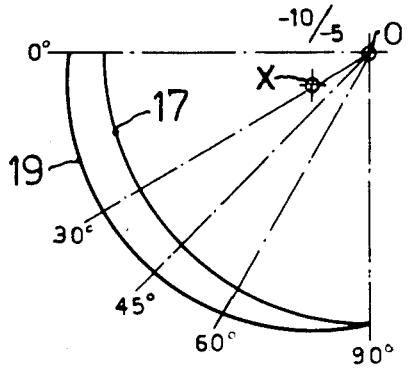
Figure 9F:
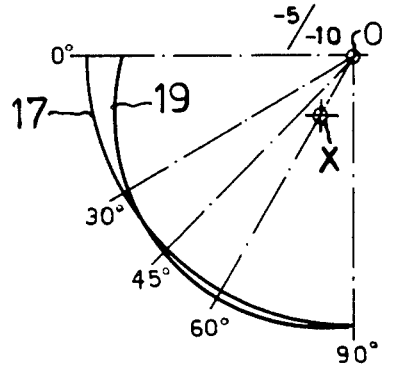

In accordance with the invention I have thus introduced a traction in the longitudinal direction of the under-leg and thereby reduced the pressure in the knee joint and hereby releaved the pain in the joint and in so doing made training possible. In the above embodiments the traction is brought about automatically as the patient extends his leg, i.e. swings the under-leg on the knee joint. The magnitude and the variation in dependence of the angular position of the under-leg depends on one hand of the characteristic of the spring or elastical member and on the other hand of the distance between the movement tracks 17 and 19 in FIG. 2, i.e. the position of the axis of rotation 7 of the resistance arm 8 with respect to the position of the knee joint. 15. This is illustrated by FIGS. 9A–9F which show different traction curves. In all of these Figures the knee joint is in the origin of coordinates 0 while the axis of rotation 7 occupies the positions X indicated in the respective Figures. From the diagrams it is evident that the distance between the curves has its maximum at an angular position which is defined by a line through the points X and O which correspond to the points 7 and 15, respectively, in FIG. 2. Under those circumstances which are represented by FIG. 9F the tractional force changes into a compressive force at an angle of rotation of about 55° as counted from the original position 90°.

By positioning the axis 7 of the training apparatus in front of as well as above the knee joint it is possible to vary the traction curve in such a way that the maximum traction is located at a predetermined (angular) position in the movement track between bent knee (90°) and completely outstretched knee (0°). By biasing the elastical member 33 an extra, constant supplement to the traction force may be obtained. If then the two axes are made to register (X located in the origin of the coordinate axes), the traction force will become constant throughout the entire movement track.

By positioning the two axes eccentrically in a predetermined position with respect to each other the traction force can be caused to increase in step with the joint pressure.

The embodiments described above and illustrated in the drawings are, of course, to be regarded merely as nonlimiting examples and may as to their details be modified in several ways within the scope of the following claims. For example through a suitable modification of the apparatus according to the invention the elastical element may be utilized for the training of other movements than those described above, the displacement of the axis of rotation 7 in relation to the knee joint being then different from that described above, so that the supplemental force to which the under-leg is subjected becomes a compressive force instead of a traction force. Furthermore, it is possible to create the whole supplemental force as well when it is a traction force as it is in the preferred embodiment, as when it is a compressive force, solely by means of the elastic element. Furthermore it is possible to envisage new embodiments which are also covered by the claims by combining details which are taken from different ones of the above examples.

What I claim is:

1. An apparatus for quadriceps training of a movement-disabled person where the lower leg is pivoted relative to the knee joint, said apparatus including seating means for seating the person so that at least one of the person's lower legs is free to pivot with the knee joint serving as a pivot axis, a resistance arm having one end mounted on a pivot axis for rotation thereabout and connected to a weight to impart a torque to said resistance arm, said pivot axis of said resistance arm being substantially parallel to but displaced from the pivot axis of the knee joint of a user when the user is using the apparatus, said resistance arm having attachment means for attaching the lower leg of a person adjacent his foot or ankle to said resistance arm, with a point on the resistance arm which, in one of the angular positions of the resistance arm, registers with a point on the foot of the person but with the point of the resistance arm moving away from the point on the foot upon rotation of the foot around the knee joint pivot axis and upon rotation of the resistance arm about its pivot axis due to the mutual paralleldisplacement of the said pivot axes, the improvement comprising means for the strapping of the upper leg of the person on said seating means in such a position that the pivot axis of the knee joint becomes substantially stationary with respect to the seat means, said resistance arm including lever means pivotally mounted on said resistance arm adjacent the end opposite said one end of said resistance arm, said attachment means securing the lower leg of a person to said lever means, said resistance arm including an elastic traction means for exerting a traction force on the leg through said lever means during the rotation of a user's leg on the pivot axis of the knee joint from a bent condition to an extended substantially straight condition in the longitudinal direction of the lower leg.

2. Apparatus according to claim 1 wherein the position of the pivot axis of the resistance arm is adjustable relative to the first axis of the knee joint of the user.

3. An apparatus according to claim 1 wherein said attachment means comprises a scale and a pointer, wherein said pointer is movable along said scale and in response to the rotational movement of the under-leg during the quadriceps training for indicating the traction force, to which the under-leg of the person is subjected during the training.

4. Apparatus according to claim 1, wherein said resistance arm comprises a sleeve which is displaceable upon and lockable to the resistance arm and through which the shoe is connected to the resistance arm.

5. Apparatus according to claim 4, wherein said attachment means comprises a three-armed lever having an axis of rotation which is stationary with respect to said sleeve, said three-armed lever including a first arm to the free end of which said shoe is secured, a second arm between the free end of which and the sleeve said elastic traction means is mounted for becoming deformed upon the rotation of the lever, and a third arm which is comprised of a pointer.

6. Apparatus according to claim 4, wherein the resistance arm is tubular, and the elastic traction means is mounted in the resistance arm between a first stop on the sleeve and a second stop on the resistance arm.

7. An apparatus according to claim 1 wherein said elastic means is connected between said lever means and said resistance arm so as to exert a force which is directed away from the pivot axis of the knee joint upon the underleg upon the rotational movement of the underleg from a bent position towards a straightened out or extended position.

8. An apparatus according to claim 1 further comprising a weight arm rigidly interconnected with said resistance arm and rotatable in concert therewith, wherein said weight arm is provided with a weight which is displaceable along said weight arm.

9. The apparatus according to claim 1 comprising a weight arm rigidly interconnected with said resistance arm and rotatable in concert therewith, wherein said weight arm is provided with a weight which is adjustable with respect to its magnitude.

10. The apparatus according to claim 1 wherein said apparatus further includes a shoe for firmly embracing the foot of the person using the apparatus for quadriceps training, said shoe being connected to said resistance arm through said elastic traction means.

* * * * *